US007610949B2

(12) United States Patent
Palanchon

(10) Patent No.: US 7,610,949 B2
(45) Date of Patent: Nov. 3, 2009

(54) HEAT EXCHANGER WITH BYPASS

(75) Inventor: Herve Palanchon, Toronto (CA)

(73) Assignee: Dana Canada Corporation, Oakville, Ontario (CA)

( * ) Notice: Subject to any disclaimer, the term of this patent is extended or adjusted under 35 U.S.C. 154(b) by 527 days.

(21) Appl. No.: 11/559,042

(22) Filed: Nov. 13, 2006

(65) Prior Publication Data

US 2008/0110595 A1 May 15, 2008

(51) Int. Cl.
*F28F 27/02* (2006.01)
*F28F 3/00* (2006.01)
*F02B 47/08* (2006.01)

(52) U.S. Cl. ..... 165/103; 165/153; 165/166

(58) Field of Classification Search ..... 165/103, 165/153, 165, 166, 167, 168, 173
See application file for complete search history.

(56) References Cited

U.S. PATENT DOCUMENTS

| | | | | |
|---|---|---|---|---|
| 6,141,961 | A * | 11/2000 | Rinckel | 60/288 |
| 6,250,380 | B1 * | 6/2001 | Strahle et al. | 165/167 |
| 6,330,910 | B1 | 12/2001 | Bennett | |
| 6,360,532 | B2 | 3/2002 | Strahle et al. | |
| 6,807,955 | B2 * | 10/2004 | Leedham et al. | 123/568.12 |
| 7,032,577 | B2 | 4/2006 | Rosin et al. | |
| 7,036,565 | B2 * | 5/2006 | Brost et al. | 165/103 |
| 7,168,419 | B2 * | 1/2007 | Rosin et al. | 123/568.12 |
| 7,264,040 | B2 * | 9/2007 | Bush et al. | 165/103 |
| 2003/0015184 | A1 | 1/2003 | Klipfel et al. | |
| 2004/0069475 | A1 * | 4/2004 | Brost et al. | 165/173 |
| 2004/0107949 | A1 * | 6/2004 | Miyoshi et al. | 123/568.12 |
| 2004/0251012 | A1 | 12/2004 | Bush et al. | |
| 2004/0256086 | A1 | 12/2004 | Brost | |
| 2005/0006060 | A1 | 1/2005 | Brost et al. | |
| 2005/0199381 | A1 | 9/2005 | Mercz et al. | |
| 2006/0032613 | A1 | 2/2006 | Brost et al. | |
| 2006/0162706 | A1 | 7/2006 | Rosin et al. | |

FOREIGN PATENT DOCUMENTS

| | | | |
|---|---|---|---|
| DE | 19962863 | A1 | 6/2001 |
| DE | 10142539 | A1 | 3/2003 |
| DE | 10203003 | A1 | 8/2003 |

(Continued)

OTHER PUBLICATIONS

International Search Report issued in respect of corresponding International application No. PCT/CA2007/00216.

*Primary Examiner*—Tho V Duong
(74) *Attorney, Agent, or Firm*—Ridout & Maybee LLP

(57) ABSTRACT

A heat exchanger with an external bypass is formed by a core portion including a plurality of stacked tubular members and a corrugated bypass tube positioned substantially parallel to the core portion. A first set of flow passages is defined within the tubular members for the flow of a first fluid therethrough, and a second set of flow passages is defined between adjacent tubular members as the tubular members are stacked together to form the core portion. A pair of external end plates is sealingly attached to transverse end wall portions of the stacked tubular members and to the ends of the bypass tube thereby forming the heat exchanger with an external bypass that comprises a single unit that can be brazed or joined together in a single operation.

20 Claims, 8 Drawing Sheets

FOREIGN PATENT DOCUMENTS

| | | | |
|---|---|---|---|
| DE | 10228619 | A1 | 1/2004 |
| DE | 102005021395 | A1 | 1/2006 |
| DE | 102005021397 | A1 | 1/2006 |
| DE | 102004045021 | A1 | 4/2006 |
| DE | 1020006005246 | A1 | 8/2006 |
| EP | 1030050 | A1 | 8/2000 |
| EP | 1275838 | A1 | 1/2003 |
| EP | 1288603 | A2 | 3/2003 |
| EP | 1363012 | A1 | 11/2003 |
| EP | 1363013 | A1 | 11/2003 |
| ES | 2209610 | A1 | 6/2004 |
| FR | 2854200 | A1 | 10/2004 |
| JP | 63088212 | A | 4/1988 |
| WO | 0210574 | A1 | 2/2002 |
| WO | 02052142 | A1 | 7/2002 |
| WO | 03062625 | A1 | 7/2003 |
| WO | 03098026 | A1 | 11/2003 |
| WO | 2005024193 | A1 | 3/2005 |
| WO | 2005042960 | A1 | 5/2005 |
| WO | 2005075928 | A1 | 8/2005 |
| WO | 2005111385 | A1 | 11/2005 |
| WO | 2005111386 | A1 | 11/2005 |
| WO | 2006029700 | A2 | 3/2006 |
| WO | 2006082049 | A1 | 8/2006 |

* cited by examiner

HEAT EXCHANGER WITH BYPASS

FIELD OF THE INVENTION

The invention relates to heat exchangers, and in particular, to heat exchangers with an integrated by-pass tube.

BACKGROUND OF THE INVENTION

Motor vehicles with internal combustion engines are sometimes equipped with an exhaust gas cooler or element in the exhaust system of the vehicle to permit cooling and/or recirculation of exhaust gas under certain operating conditions. The exhaust element has an inlet for receiving exhaust gas from the engine and an outlet for the exhaust gas to be recirculated back to the engine air intake or to other components in the exhaust line. Typically, the exhaust element includes an exhaust pipe extending between the inlet and outlet of the exhaust element, and a heat exchanger mounted generally in parallel with the exhaust pipe between the inlet and outlet of the exhaust element. Regulating or flow diversion means in communication with the inlet or outlet of the exhaust element directs the flow of the exhaust gas through either the exhaust pipe or through the heat exchanger to the outlet. When the exhaust gas is directed through the heat exchanger, the exhaust gas is cooled and the heat is transferred usually to the engine coolant. In addition to cooling the exhaust gas, this type of heat transfer is advantageous under cold conditions as it allows the cooling system in the vehicle to quickly reach optimal operating temperature, and the heated coolant can be used to warm up other fluids or areas of the vehicle. The exhaust element can be formed as either an "internal bypass" system wherein the heat exchanger and the bypass are enclosed in a common housing, or as an "external bypass" system wherein the heat exchanger and bypass are separate to each other with no common housing.

U.S. Pat. No. 6,141,961 to Rinckel discloses an exhaust element that includes a main exhaust pipe and a bypass. In this embodiment, the bypass is comprised of a heat exchanger mounted in parallel with and external to the main exhaust pipe. The main pipe is formed of two separate tubular sections that are joined by bellows to provide for some expansion of the main pipe. Moveable means for shutting off the main pipe and for regulating the cross-sectional area provided for the gases to pass through the bypass are arranged in the inlet end of the exhaust element. The moveable means are housed within a diverging adapter having a first end for coupling to the exhaust gas feed or inlet and a second end for coupling with the inlet of the main exhaust pipe and the inlet of the bypass. In order to accommodate the separate ends of the main exhaust pipe and the heat exchanger or bypass portion, the adapter includes a central strut member that effectively divides the second end of the adapter into two separate openings—one for receiving the inlet end of the main pipe and one for receiving the inlet end of the bypass. The cross-section of the strut member is generally in the form of a "hair-pin", which allows the main pipe and the bypass to essentially be clamped together in their parallel relationship when the adapter is fitted on the ends thereof. A converging adapter is positioned at the outlet ends of the main pipe and the bypass for directing the flow of the exhaust gas to atmosphere.

The overall structure of Rinckel's exhaust element is somewhat complex in that the main exhaust pipe and bypass are held together by means of adapters with quite complex structures. More specifically, as mentioned above, the diverging adapter is formed with a complex hair-pin strut member that must be positioned on the ends of the main pipe and bypass before the exhaust element can be joined together, most likely by brazing. The overall assembly of the components is quite cumbersome, and it is difficult to achieve a proper seal or joint between the ends of the main pipe and bypass and the hair-pin strut member, which may affect the overall performance of the exhaust element and may increase the likelihood of failure.

International published application WO 2005/111385, in the name of Behr GmbH & Co. KG, discloses a heat exchanger for internal combustion engines having a first elongate flow channel for the passage of exhaust gas from the engine and a second flow channel or bypass arranged adjacent to the first flow channel, also for the passage of exhaust gases. The first and second flow channels are housed within a common housing and end caps or brackets, which fit into the ends of the housing, hold the first and second flow passages in place therein. The heat exchanger, therefore, can be classified as an internal bypass system. A medium such as a coolant is provided by means of a pipe in communication with the housing for heat exchange between the exhaust gas in the first flow channel and the medium. A valve channel with an adjustable valve element communicates with the inlet ends of the first and second flow channels for regulating or adjusting the amount of exhaust gas flowing through either the first or second flow channels. With an internal bypass arrangement, it is difficult to insulate the second or bypass channel from the first flow channel so that heat exchange between the two does not occur as both of the channels are usually in contact with the medium or coolant.

SUMMARY OF THE INVENTION

In the present invention, a pair of external end plates are sealingly attached to transverse end wall portions of a plurality of stacked tubular members and to the ends of a bypass tube located in a generally parallel arrangement thereby forming a heat exchanger with an external bypass that comprises a single unit that can be brazed together in a single operation.

According to the invention, there is provided a heat exchanger comprising a plurality of stacked tubular members defining a first set of flow passages therethrough. The tubular members have a boss portion located at each end thereof. The boss portions define respective inlet and outlet openings therein. The respective inlet and outlet openings of each of the stacked tubular members communicate to define inlet and outlet manifolds for the flow of a first fluid through the first set of flow passages. The tubular members have opposed peripheral flange portions joined together in the stacked tubular members to define a second set of flow passages between the adjacent tubular members for the flow of a second fluid through the heat exchanger. The tubular members also have transverse end wall portions defining a sealing surface. A corrugated bypass tube is located generally parallel to the plurality of stacked tubular members. The corrugated bypass tube is exposed to ambient air and has opposed end portions defining open ends for the flow of additional second fluid therethrough. The heat exchanger further includes a pair of external end plates located respectively at the ends of the stacked tubular members and the corrugated bypass tube. Each end plate has a peripheral wall defining a first opening for allowing the second fluid to flow through the second set of flow passages. The peripheral wall is sealingly attached to the transverse end wall portions of the plurality of stacked tubular members, and each end plate defines a second opening sealingly attached to one of the end portions of the corrugated bypass tube.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
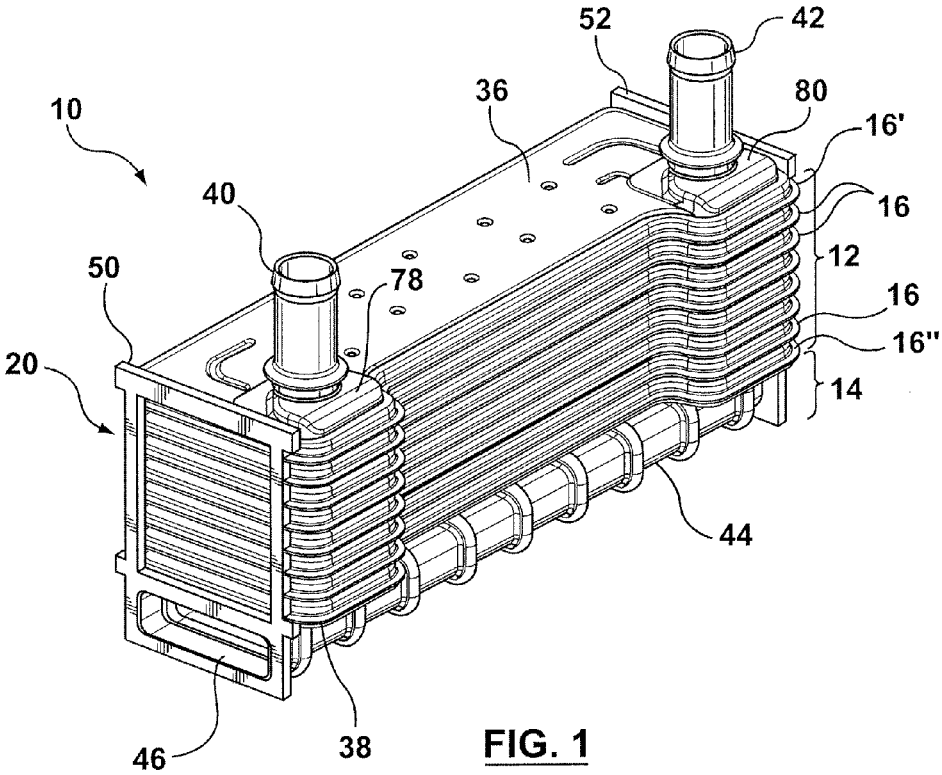
FIG. 1 is a perspective view of a preferred embodiment of a heat exchanger according to the present invention.
Figure 2:
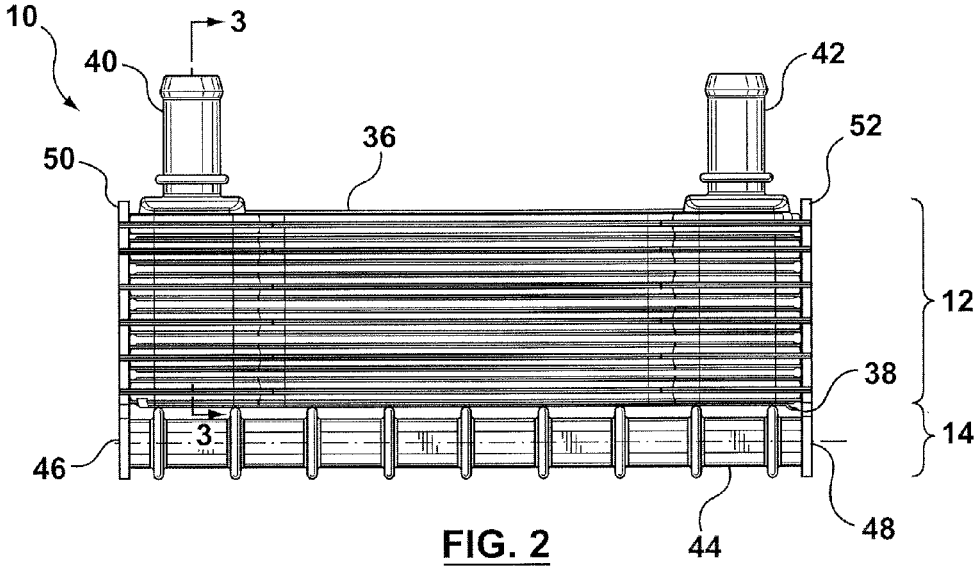
FIG. 2 is side elevation view of the heat exchanger shown in FIG. 1.

Referring to the drawings, there is shown in FIG. 1 a heat exchanger 10 according to a preferred embodiment of the invention. Heat exchanger 10 is comprised of a core portion 12 and a bypass portion 14. The core portion 12 is formed by a plurality of stacked tubular members 16 which define a first set of flow passages 18 therethrough (see FIG. 3) for the flow of a first fluid, such as a coolant, through the heat exchanger 10. A second set of flow passages 20 is defined between adjacent tubular members 16 for the flow of a second fluid, such as exhaust gas, through the heat exchanger 10. Turbulizers 21 may be located in the second set of flow passages 20 to increase heat exchange. While tubular members 16 may be formed by a single tubular element, they may also be formed of upper and lower plates 22, 24 and, therefore, may also be referred to as plate pairs. The tubular members 16 (or plate pairs) have boss portions 26, 28 (see FIG. 4), one at each end of the tubular members 16. In a preferred embodiment, both of the boss portions 26, 28 are positioned to one side of the longitudinal axis 29 of the tubular members 16. The boss portions 26, 28 have respective inlet or outlet openings 30 (see FIG. 3) so that when the tubular members 16 are stacked together, the inlet/outlet openings 30 communicate to define inlet and outlet manifolds 32, 34. Top plate 36 of the core portion 12 is provided with inlet and outlet fittings 40, 42 for the flow of fluid into and out of the inlet and outlet manifolds 32, 34. Bottom plate 38 has no boss portions or inlet/outlet openings formed therein and, therefore, closes the inlet/outlet manifolds 32, 34. The bypass portion 14 is formed by a corrugated bypass tube 44 positioned substantially parallel to the bottom plate 38 of the core portion 12. The bypass tube 44 has end portions 46, 48 defining open ends for the flow of additional second fluid therethrough. A pair of external end plates 50, 52 holds the core portion 12 and the bypass portion 14 together in their spaced apart relationship as a single unit.

When the tubular members 16 are formed using plate pairs, upper and lower plates 22, 24 are typically identical in structure. However, when assembling the core portion 12 of the heat exchanger 10, alternating plates are inverted and rotated 180 degrees with respect to the adjacent plate. In other words, the plates are placed face to face, so that the boss portions 26, 28 are aligned in each plate pair. This will be appreciated when considering FIGS. 4 and 5, which illustrate the upper and lower plates 22, 24 opened in a butterfly fashion.

Figure 3:
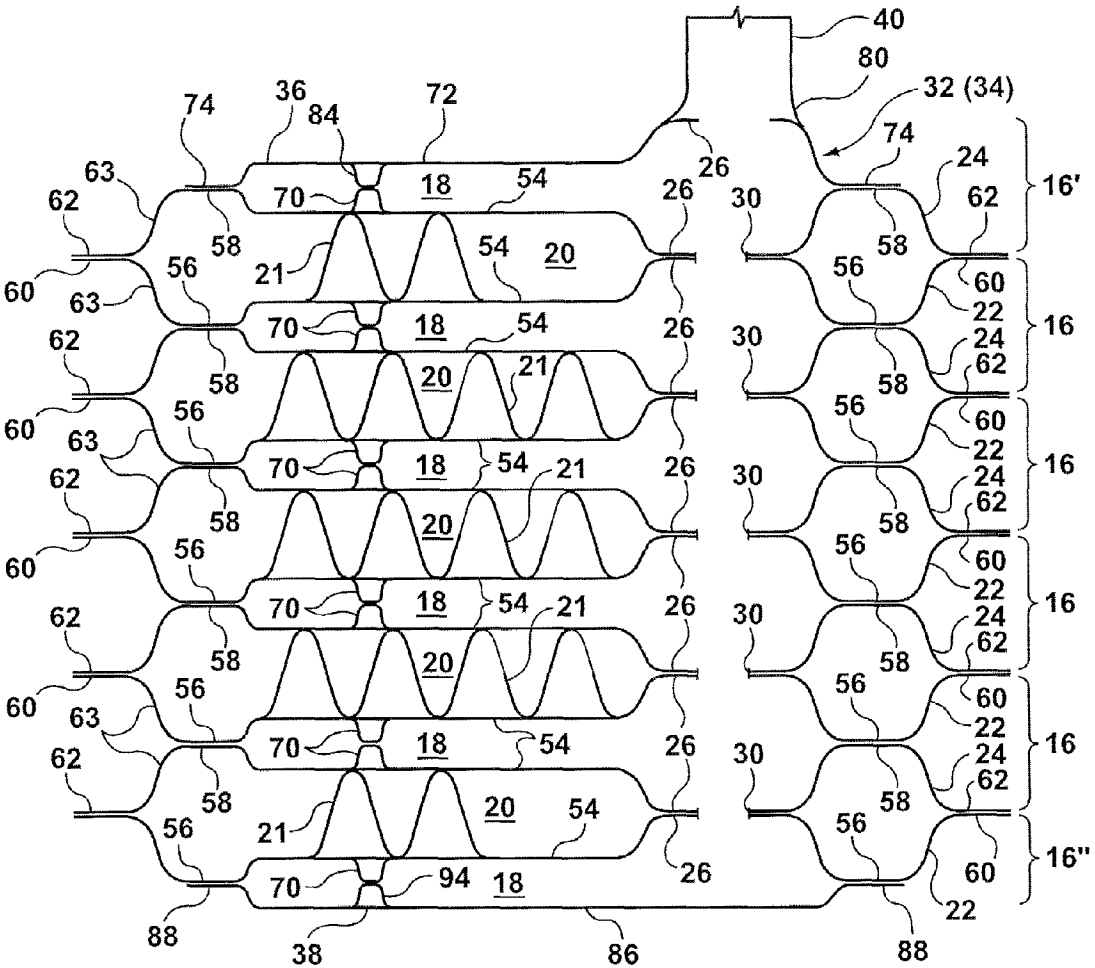
FIG. 3 is a cross-sectional view of the heat exchanger core portion taken along section line 3-3 shown in FIG. 2.
Figure 4:
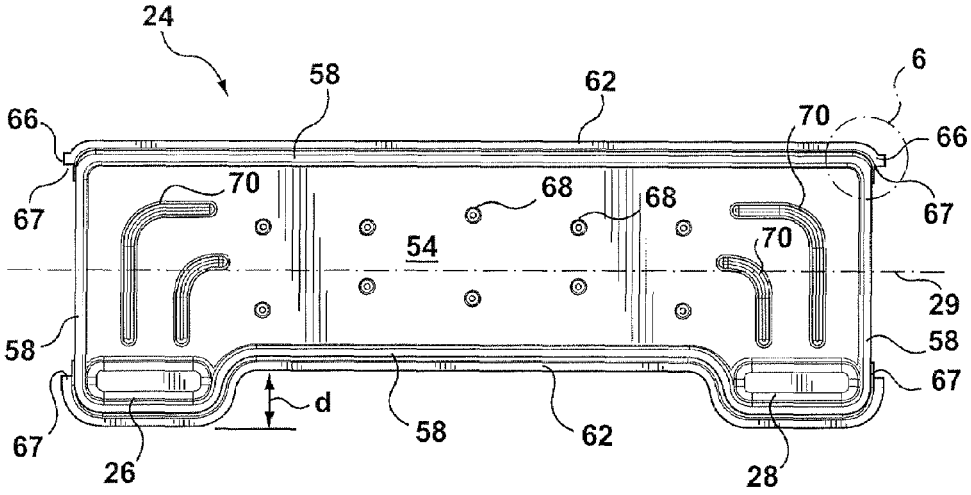
FIG. 4 is an inside view of the lower plate that forms part of the plate pairs or tubular members that make up the core portion of the heat exchanger shown in FIGS. 1-3.
Figure 5:
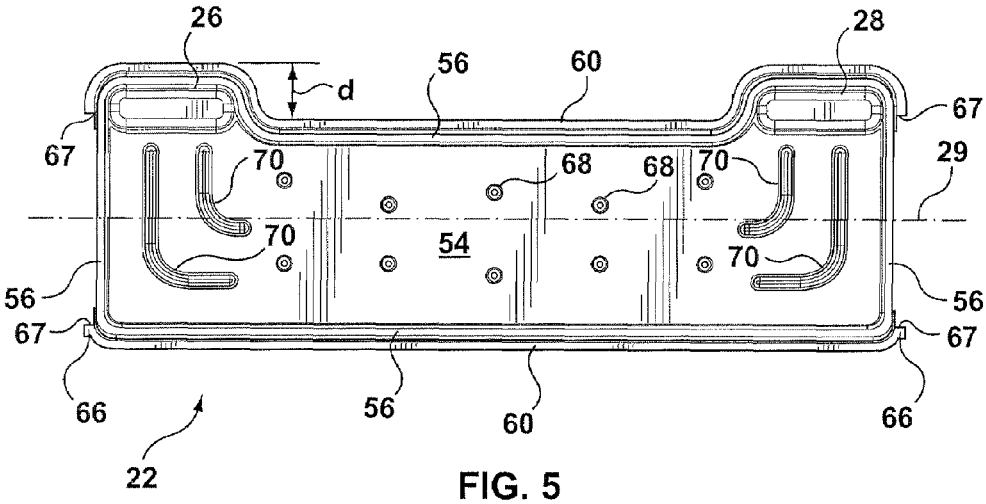
FIG. 5 is an inside view of the upper plate that forms part of the plate pairs or tubular members that make up the core portion of the heat exchanger.
Figure 6:
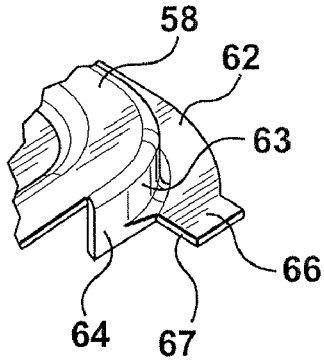
FIG. 6 is an enlarged, perspective view of a corner of the lower plate as indicated by circle 6 in FIG. 4.

Referring now to FIGS. 3 to 5, each plate 22, 24 has a central, generally planar portion 54. As mentioned above, boss portions 26, 28 are positioned to one side of the longitudinal axis 29 of the plate and extend slightly beyond the boundary of the central, generally planar portion 54 by a distance d, thereby giving one edge of the plates 22, 24 a slight C-shaped profile. Boss portions 26, 28 project out of the plane of the central, generally planar portion 54 of the plates 22, 24 by a distance equal to half the height of the second set of flow passages 20. A first flange portion 56, 58, which extends around the periphery of the plates 22, 24 surrounding boss portions 26, 28, is formed in a different plane than both the central, generally planar portion 54 and the boss portions 26, 28. When considering the upper plate 22 of a plate pair (see FIG. 3), the first flange portion 56 is viewed as a depression with respect to the central, generally planar portion 54; however, when considering the lower plate 24, the first flange portion 58 is raised with respect to the central, generally planar portion 54 of the plate 24. Therefore, when the plates 22, 24 are stacked in their alternating, face-to-face relationship, the first flange portions 56, 58 come into contact thereby spacing apart the central, generally planar portions 54 of the plates 22, 24 and defining the first set of flow passages 18 between the plates 22, 24, as shown in FIG. 3. Second flange portions 60, 62, which are formed in the same plane as boss portions 26, 28, run along the longitudinal edges of the plates 22, 24 and extend slightly around the corners thereof. The second flange portions 60, 62 may terminate with optional outwardly projecting tabs 66, as sown in FIG. 6. In any event, the distal ends 67 of flange portions 60, 62 retain the end plates 50, 52 therebetween to make heat exchanger 10 somewhat self-fixturing. Side walls 63 extend respectively between flange portions 58, 62 and 56, 60. Side walls 63 terminate in end wall portions 64, which close off a small portion of the second set of flow passages 20. Other than the end wall portions 64 closing off a minimal portion of the second set of flow passages 20, the second set of flow passages 20 have open ends for the flow of a fluid therethrough when the plates 22, 24 are stacked together.

Referring again to FIG. 3, when considering the upper plate 22, the second flange portion 60 is raised with respect to both the central, generally planar portion 54 and the first flange portion 56 and, as mentioned above, lies generally in the same plane as the raised boss portions 26, 28. However, when considering the lower plate 24, the second flange portion 62 is viewed as a depression with respect to the central, generally planar portion 54 and the first flange portion 58. When the upper and lower plates 22, 24 are stacked in their face-to-face relationship, the second flange portion 60 of the upper plate 22 of the plate pair contacts the second flange portion 62 of the lower plate 24 in the adjacent plate pair, and the boss portion 26 of the upper plate 22 contacts the corresponding boss portion 26 of the lower plate 24 in the adjacent plate pair. The contact between the corresponding boss portions 26 and the second flange portions 60, 62 in the adjacent plate pairs serves to space apart the adjacent plate pairs, thereby defining the second set of flow passages 20 therebetween. The contact between the plates 22, 24 also provides suitable joining or mating surfaces to ensure that the plates 22, 24 have an adequate seal when joined together.

In a preferred embodiment, the second set of flow passages 20 have turbulizers 21 located therein. The turbulizers are typically formed of expanded metal or any other suitable material to produce undulating flow passages which create mixing or turbulence in the flow thereby increasing heat exchange. As for the first set of flow passages 18, the upper and lower plates 22, 24 may have inwardly disposed, spaced-apart mating dimples or protrusions 68 formed in their central, generally planar portions 54. The dimples 68 serve to create flow turbulence or mixing within the first set of flow passages 18 to enhance heat exchange, and also maintain the flow channel height and support for planar portions 54, especially during the brazing of heat exchanger 10, as well as add strength to the heat exchanger. The central, generally planar portions 54 may also be formed with inwardly disposed ribs 70 leading from the boss portions 26, 28 around the corners of the plates 22, 24 so as to direct or guide the flow of fluid from the inlet manifold 32 (or 34) to the central, generally planar portion 54 and from the central, generally planar portion 54 to the outlet manifold 34 (or 32).

Inlet and outlet manifolds 32, 34 are formed as the tubular members 16 or plate pairs are stacked together. The inlet or outlet openings 30 in the boss portions 26, 28 are aligned and come into contact with each other when the tubular members 16 or plate pairs are stacked together so that fluid communication is established between the first set of flow passages 18. It will be understood that the inlet and outlet manifolds 32, 34 are interchangeable, the requirement being that fluid flows from one of the manifolds 32 or 34 through the first set of flow passages 18 to the other of the manifolds 32, 34.

Figure 7:
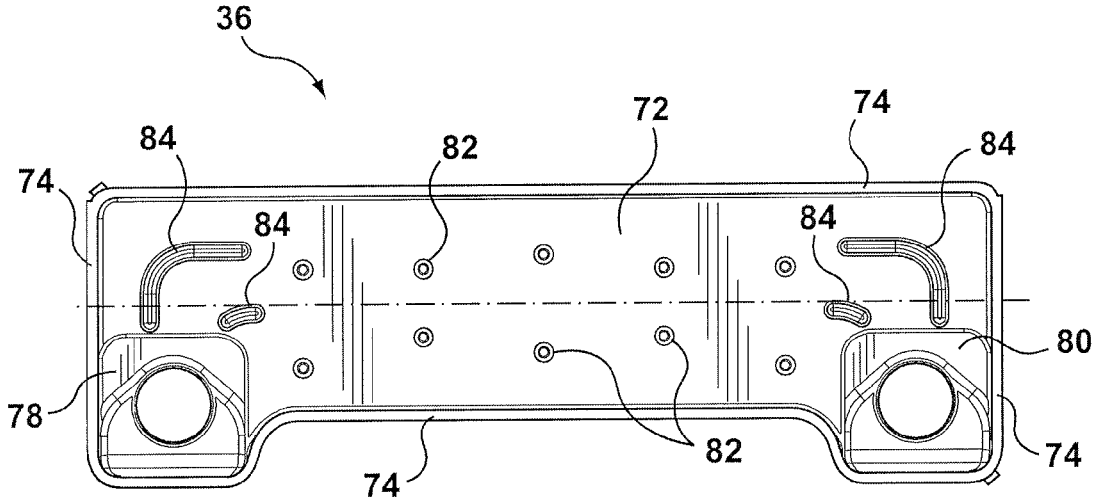
FIG. 7 is a top view of the top plate of the heat exchanger as shown in FIG. 1.
Figure 8:
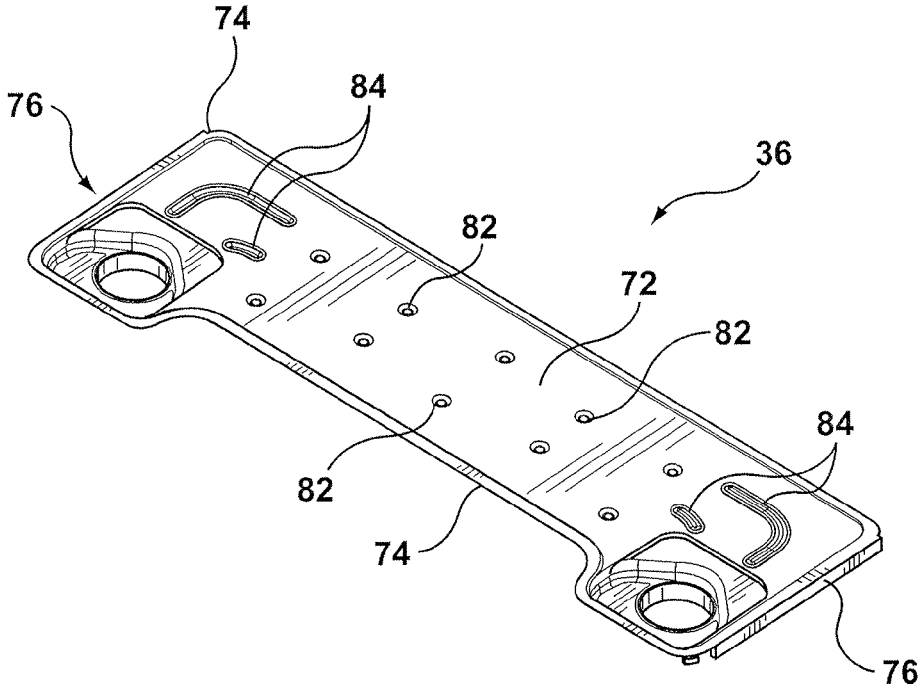
FIG. 8 is a perspective view of the underside of the top plate shown in FIG. 7.

The top plate 36 (see FIGS. 3, 7 and 8) acts as the upper plate of the uppermost plate pair or top tubular member 16' in the core portion 12 of the heat exchanger 10. Top plate 36 has a central, generally planar portion 72 similar to the central generally planar portions 54 of the plates 22, 24 that make up the core 12. However, top plate 36 is formed with only one flange portion 74 that extends around the periphery of the top plate 36 so as to correspond to the first flange portion 58 of the lower plate 24 when the top plate 36 and its associated lower plate 24 are stacked together creating one of the flow passages 18 therebetween (see FIG. 3). Opposed transverse end walls 76 (see FIG. 8) are formed at each end of the top plate 36 which extend upwardly from the flange portion 74 at substantially 90 degrees thereto. The end walls 76 provide a flat surface for abutting against the end plates 50, 52 when the core portion 12 and bypass portion 14 are assembled, as will be described in further detail below. As well, rather than having boss portions 26, 28 identical to those found in the core plates 22, 24, the top plate 36 is equipped with mountings 78, 80 for receiving the inlet and outlet fittings 40, 42. The top plate 36 can also be formed with inwardly depending dimples 82 and guide ribs 84 as described above in connection with core plates 22, 24.

Figure 9:
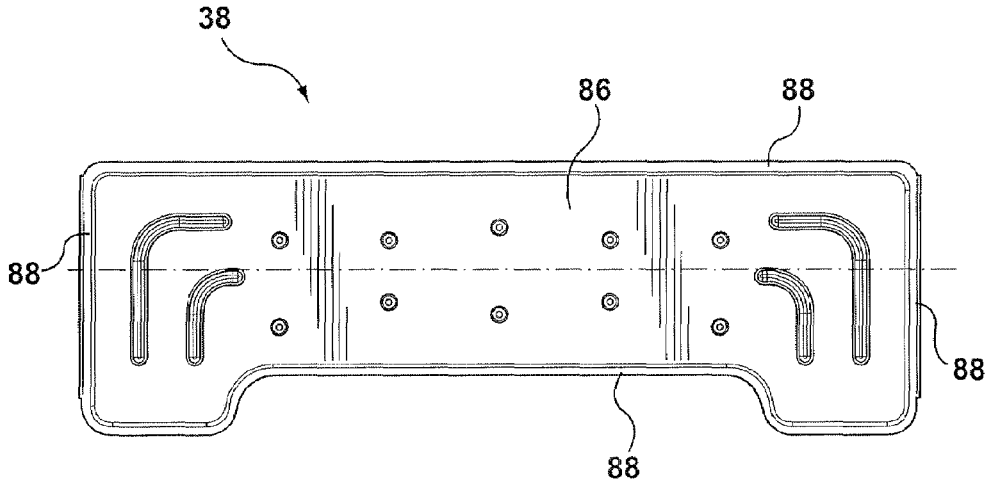
FIG. 9 is a top view of the bottom plate of the heat exchanger as shown in FIG. 1.
Figure 10:
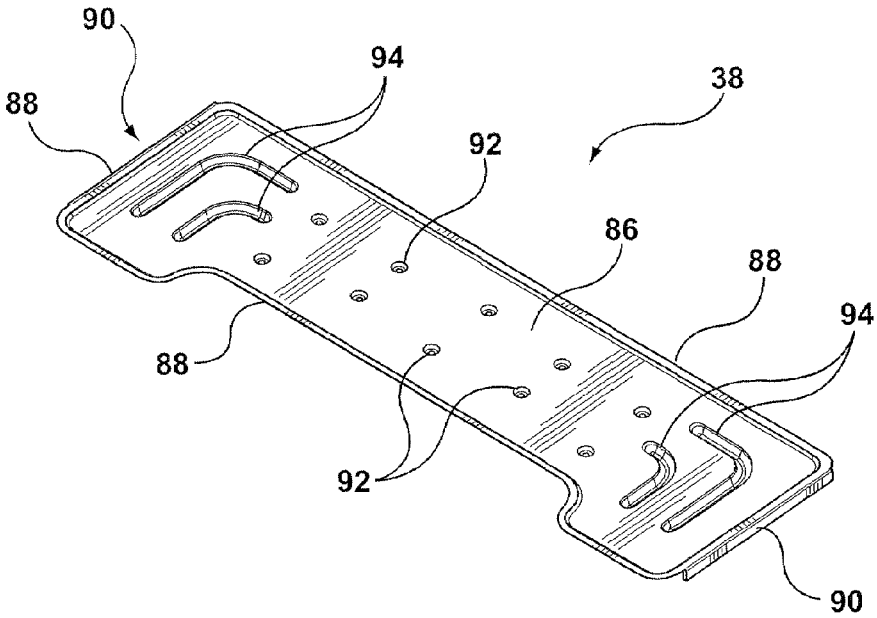
FIG. 10 is a perspective view of the underside of the bottom plate shown in FIG. 9.

Bottom plate 38 (see FIGS. 3, 9 and 10) acts as the lower or bottom plate of the lowermost plate pair or bottom tubular member 16" and is similar in structure to top plate 36 in that it too has a central, generally planar portion 86 and only a first flange portion 88 extending around the periphery of the plate 38. The flange portion 88 contacts the first flange portion 56 of the lowermost upper plate 22 when they are stacked together creating one of the flow passages 18 therebetween (see FIG. 3). The bottom plate 38, however, does not have any boss portions 26, 28 formed therein as the bottom plate 38 closes off the inlet and outlet manifolds 32, 34. Like the top plate 36, opposed transverse end walls 90 (see FIG. 10) are formed at each end of the plate 38. The end walls 90 extend downwardly, at substantially 90 degrees to the flange portion 88. The end walls 90 provide a flat surface for abutting against the end plates 50, 52 when the core portion 12 and bypass portion 14 are assembled, as will be described in detail below. The bottom plate 38 can also be formed with inwardly depending dimples 92 and guide ribs 94, as described in connection with core plates 22, 24.

Figure 11:
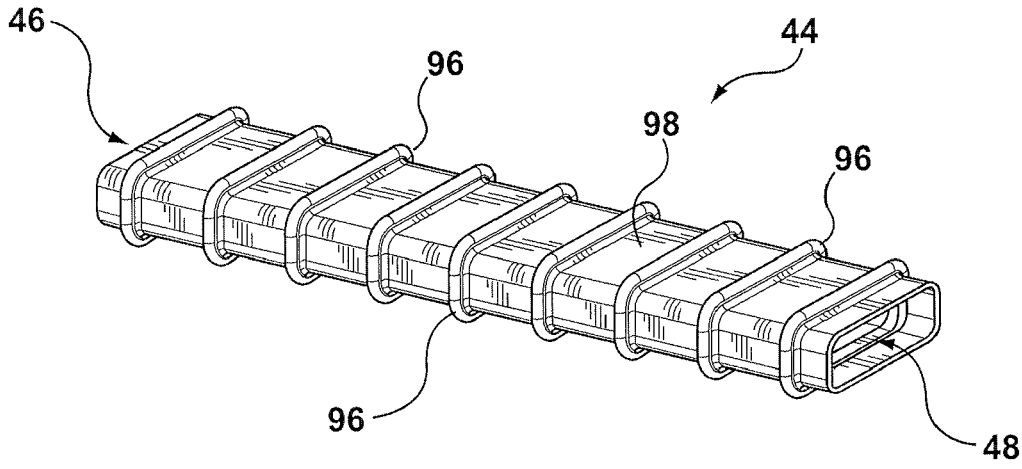
FIG. 11 is a perspective view of the bypass tube that forms the bypass portion of the heat exchanger shown in FIG. 1.
Figure 12:
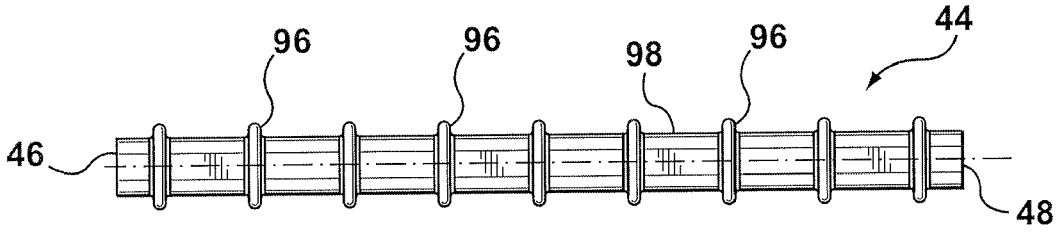
FIG. 12 is a side view of the bypass tube shown in FIG. 11.
Figure 13:
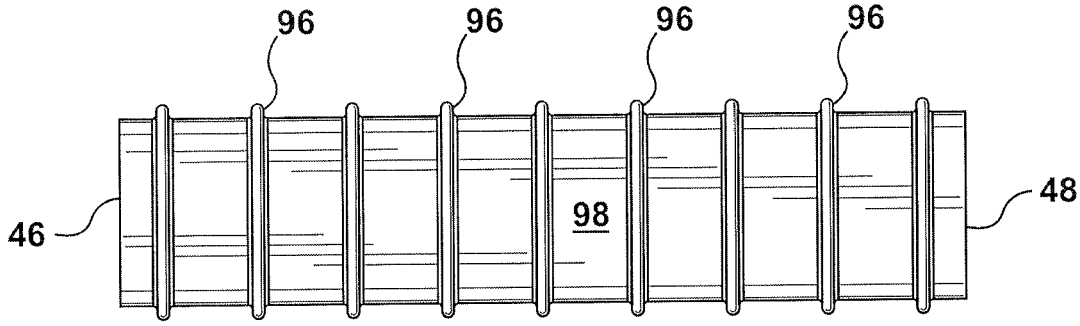
FIG. 13 is a top view of the bypass tube shown in FIGS. 11 and 12.

Referring now to FIGS. 11 to 13, the bypass portion 14 of the heat exchanger 10 is comprised of corrugated tube 44 with open ends or end portions 46, 48. Corrugations or ribs 96 project outwardly from the wall 98 of the tube 44 and provide a degree of flexibility to the tube in that it can expand and contract in response to the variations in temperature it experiences under its various operating conditions. According to a preferred embodiment, the corrugated tube 44 is formed by hydro-forming, although any suitable method of manufacture can be used.

Figure 16:
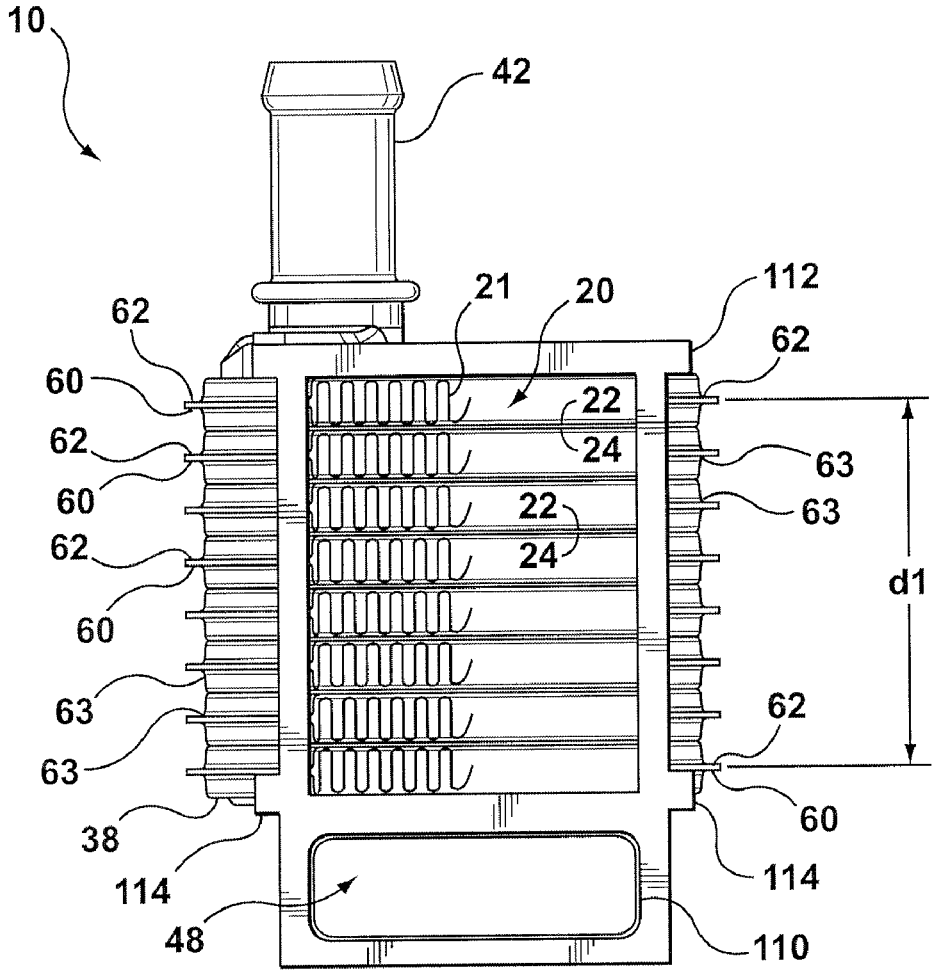
FIG. 16 is a right end view of the heat exchanger shown in FIG. 1.
Figure 14:
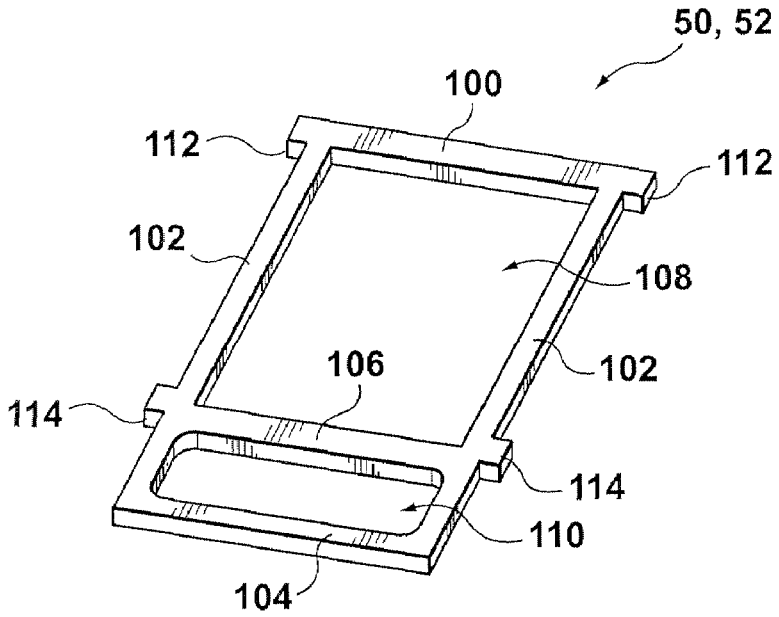
FIG. 14 is a perspective view of an end plate of the heat exchanger shown in FIG. 1.
Figure 15:
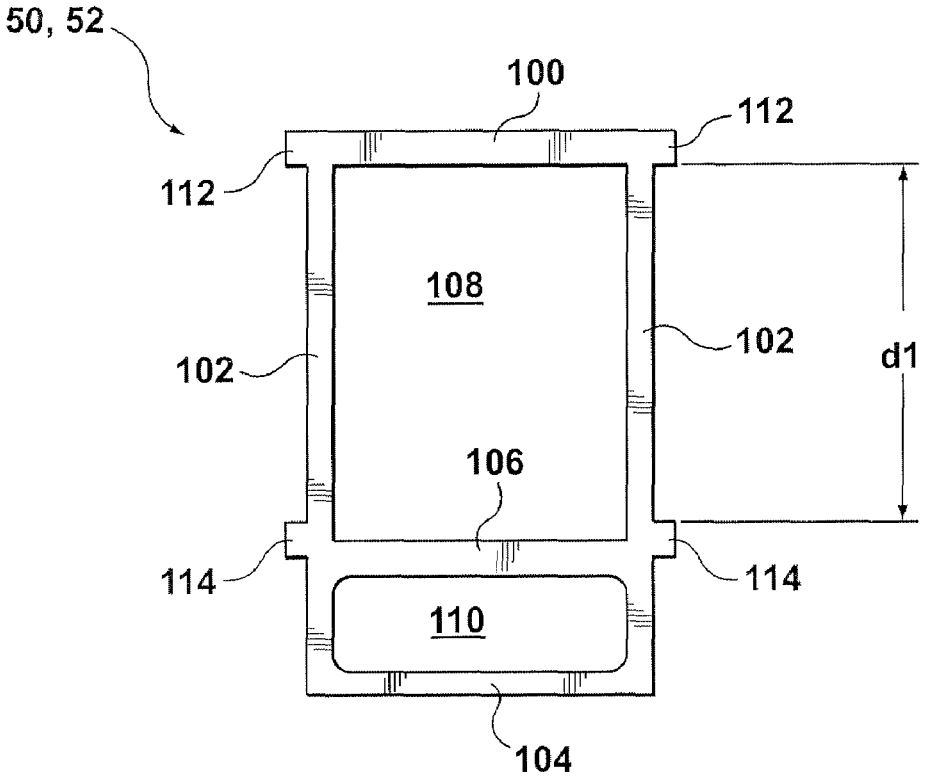
FIG. 15 is an end view of the end plate shown in FIG. 14.

To form the heat exchanger 10, the core portion 12 and bypass portion 14 are held generally parallel and spaced apart from each other by end plates 50, 52 that are located respectively at the ends of the stacked tubular members 16 and bypass tube 44 and are thus attached externally on the core portion 12 and bypass portion 14. The end plates 50, 52 (see FIGS. 14 and 15) are comprised of a generally rectangular frame having a top bar 100, two side bars 102 and a bottom bar 104. A cross-bar 106 defines two separate openings 108, 110 in each of the end plates 50, 52, the first opening 108 being larger than the second opening 110. Top bar 100, cross-bar 106 and the portions of side bars 102 therebetween form a peripheral wall that is sealingly attached to the transverse end wall portions 64 and the transverse end walls 76 and 90 of the tubular members 16, and also define first opening 106. Cross-bar 106, bottom bar 104 and the portions of side bars 102 therebetween define second opening 110. A first set of side tabs 112 project laterally from the ends of the top bar 100 beyond the side bars 102. A second set of side tabs 114 project laterally from the side bars 102 substantially parallel to and spaced from the first set of side tabs 112, and are located slightly above cross-bar 106. The distance d1 between the first and second sets of spaced-apart side tabs 112, 114, corresponds to the height of the core portion 12 of the heat exchanger 10 (see FIGS. 15 and 16). The width of the end plates 50, 52, or the distance between the outermost edges of the side bars 102, corresponds to the distance defined between the flange distal ends 67 at the ends of the tubular members 16 that make up the core portion 12.

The top and bottom plate transverse end walls 76, 90 and the tubular member transverse end wall portions 64 are located in the same plane and form a continuous peripheral sealing surface that is attached to the end plate peripheral walls in a lap joint configuration.

When the heat exchanger 10 is assembled (see FIG. 16), the side bars 102 of the end plates 50, 52 are received in the space defined between the projecting distal ends 67. The top bar 100 abuts the end wall 76 of the top plate 36 of the core portion 12, and the first set of side tabs 112 sits on the ends of the uppermost second flange portions 60, 62 that extend from the core portion 12. The second set of side tabs 114 are positioned underneath the ends of the lowermost second flange portions 60, 62 with the cross bar 106 abutting the end wall 90 of the bottom plate 38. The second flange portions 60, 62, or at least the projecting tabs 66 of these flange portions, are thus retained in positions by the side tabs 112, 114, again making heat exchanger 10 somewhat self-fixturing. Therefore, the core portion 12 is effectively held by end plates 50, 52 between the two sets of side tabs 112, 114. However, after heat exchanger 10 is brazed, the side tabs 112, 114 may not end up touching the second flange portions 60, 62 or tabs 66 due to differential expansion and contraction between the end plates 50, 52 and tubular members 16 during the brazing process.

With the end plates 50, 52 in position, the first opening 108 in the plates 50, 52 permits fluid to flow through the second set of flow passages 20 located between tubular members 16. The surface contact between the side bars 102 of the end plates 50, 52 and the end wall portions 64 of the tubular members 16, as well as the surface contact between the top bar 100 and the end wall 76 of the top plate 36, and the cross bar 106 and the end wall 90 of the bottom plate, allows for good surface-to-surface bonds or sealed joints to be formed between the components during brazing or any other suitable joining procedure.

As for the bypass portion 14 of the heat exchanger 10, the second opening 110 in end plates 50, 52 is shaped to correspond to the shape of the end portions 46, 48 of the corrugated bypass tube 44 so that a snug fit is created between the outer wall 98 of the bypass tube 44 and the end plates 50, 52 when the bypass tube 44 is inserted into the second openings 110. The spacing between the two openings 108, 110, which is dictated by the width of the cross-bar 106, causes the bypass tube 44 to be appropriately spaced-apart from the bottom plate 38 of the core portion 12 if desired. The width of the cross-bar 106 is selected so that the corrugations 96 on the bypass tube 44 either contact or are spaced from the bottom plate 38 of the core portion 12, as desired. If corrugations 96 are spaced from bottom plate 38, this would provide insulation between the two components 12, 14 of the heat exchanger 10. If corrugations 96 contact plate 38, this would provide strength or support for the core portion 12. If one of more of the corrugations 96 contact bottom plate 38, the corrugations 96 must either be securely brazed to bottom plate 38 or not brazed to plate 38 at all, because differential thermal expansion between bypass tube 44 and core portion 12 could cause problems if the braze joints were not strong enough to withstand this. Corrugations 96 can be prevented from brazing to bottom plate 38 by using a suitable anti-wetting agent during the brazing process.

While the present invention has been described with reference to preferred embodiments, it will be understood by persons skilled in the art that the invention is not limited to the precise embodiment described, and that variations or modifications can be made without departing from the scope of the invention as disclosed herein. For example, depending on the specific application of the heat exchanger, the height of the first and second sets of flow passages 18, 20 may vary depending on the types of fluids involved. Side tabs 112, 114 and the plate projecting tabs 66, which make the heat exchanger self-fixturing, could be eliminated. The core plates could be fixtured for the brazing process in another manner. Rather than having the tubular members 16 formed by dimpled plate pairs, the plates 22, 24 may have a smooth central planar portion 54 and other heat exchange enhancing devices such as turbulizers can be used in the first set of flow passages. As well, boss portions 26, 28 can be positioned at other locations in tubular members 16. Accordingly, it will be appreciated that the heat exchanger disclosed in the present application can be adapted to suit various applications.

What is claimed is:

1. A heat exchanger, comprising:

a plurality of stacked tubular members defining a first set of flow passages therethrough, the tubular members having a boss portion located at each end thereof, said boss portions defining respective inlet and outlet openings, the respective inlet and outlet openings of each of said stacked tubular members communicating to define inlet and outlet manifolds for the flow of a first fluid through the first set of flow passages, the tubular members having opposed peripheral flange portions joined together in the stacked tubular members to define a second set of flow passages between adjacent tubular members for the flow of a second fluid through the heat exchanger, the tubular members having transverse end wall portions defining a sealing surface;

a corrugated bypass tube located generally parallel to the plurality of stacked tubular members, the corrugated bypass tube being exposed to ambient air and having opposed end portions defining open ends for the flow of additional second fluid therethrough;

a pair of external end plates located respectively at the ends of the stacked tubular members and the corrugated bypass tube, each end plate having a peripheral wall defining a first opening for allowing said second fluid to flow through said second set of flow passages, the peripheral wall being sealingly attached to the transverse end wall portions of the plurality of stacked tubular members, and each end plate defining a second opening sealingly attached to one of the end portions of the corrugated bypass tube.

2. The heat exchanger as claimed in claim 1, wherein the bypass tube opposed end portions are located in the end plate second openings.

3. The heat exchanger as claimed in claim 2, wherein the boss portions are located to one side of the longitudinal axis of the tubular members.

4. The heat exchanger as claimed in claim 1, wherein the plurality of stacked tubular members are formed with a plurality of spaced apart, inwardly disposed dimples.

5. The heat exchanger as claimed in claim 1, wherein the plurality of stacked tubular members have inwardly disposed ribs for directing the flow of said first fluid through said first set of flow channels from the inlet opening to said outlet opening.

6. The heat exchanger as claimed in claim 1, wherein the transverse end wall portions close off a portion of the second set of flow passages, and wherein the end plate peripheral wall overlaps said end wall portions of said tubular members to form lap joints.

7. The heat exchanger as claimed in claim 1, further comprising turbulizers located in the second set of flow passages defined between the adjacent tubular members.

8. The heat exchanger as claimed in claim 1, wherein the ends of the tubular members have spaced-apart projecting tabs extending outwardly therefrom, said end plates being received between said tabs.

9. The heat exchanger as claimed in claim 1, wherein the tubular members are formed from elongate plate pairs.

10. The heat exchanger as claimed in claim 9, wherein each plate comprises:

a central generally planar portion, said boss portions being located on one side of the longitudinal axis of the plate and extending slightly beyond the boundary of the central, generally planar portion, said boss portions lying in a different plane than said central planar portion;

a first flange portion formed around the periphery of the plate, inwardly disposed from the edges thereof, said first flange portion lying in a different plane than said central planar portion and said boss portions;

a second flange portion formed along the longitudinal edges of said plate, said second flange portion lying in the same plane as said boss portions.

11. The heat exchanger as claimed in claim 10, wherein each plate is inverted and rotated 180 degrees with respect to the adjacent plate to form the plate pairs.

12. The heat exchanger as claimed in claim 10, wherein said central generally planar portion includes spaced apart inwardly disposed dimples.

13. The heat exchanger as claimed in claim 10, wherein said central generally planar portion includes inwardly disposed guide ribs for directing the flow of said first fluid longitudinally through said first set of flow channels from the inlet opening to said outlet opening.

14. The heat exchanger as claimed in claim 1 wherein the bypass tube is spaced from the stacked tubular members.

15. The heat exchanger as claimed in claim 1 wherein at least one of the bypass tube corrugations is in contact with the stacked tubular members.

16. The heat exchanger as claimed in claim 15 wherein said at least one corrugation is brazed to the stacked tubular members.

17. The heat exchanger as claimed in claim 15 wherein said at least one corrugation is not brazed to the stacked tubular members.

18. The heat exchanger as claimed in claim 1 wherein the plurality of stacked tubular members include top and bottom tubular members, the top and bottom tubular members including respectively a top plate and a bottom plate, the top and bottom plates including opposed transverse end walls located in the same plane as the tubular member transverse end wall portions, said end walls being sealingly attached respectively to the end plate peripheral walls.

19. The heat exchanger as claimed in claim 18 wherein the top and bottom plate transverse end walls and the tubular member transverse end wall portions form a continuous peripheral sealing surface attached to the end plate peripheral walls in a lap joint configuration.

20. The heat exchanger as claimed in claim 10 wherein the external end plates have spaced-apart, laterally projecting side tabs, the second flange portions of the tubular members being retained in position by said side tabs.

* * * * *